US006264193B1

(12) United States Patent
Moeller

(10) Patent No.: US 6,264,193 B1
(45) Date of Patent: Jul. 24, 2001

(54) DOCUMENT CONVEYANCE SYSTEM FOR CONVEYING SINGLE DOCUMENTS

(75) Inventor: Siegfried Moeller, Rottweil (DE)

(73) Assignee: BDT-Bürd-und Datentechnik GmbH & Co. KG., Rottweil (DE)

( * ) Notice: Subject to any disclaimer, the term of this patent is extended or adjusted under 35 U.S.C. 154(b) by 0 days.

(21) Appl. No.: 09/405,125

(22) Filed: Sep. 24, 1999

(30) Foreign Application Priority Data

Sep. 26, 1998 (DE) ..... 198 44 271

(51) Int. Cl.[7] ..... B65H 31/26
(52) U.S. Cl. ..... 271/220; 271/314; 271/184
(58) Field of Search ..... 271/314, 220, 271/902, 184; 270/58.27

(56) References Cited

U.S. PATENT DOCUMENTS

| | | | | |
|---|---|---|---|---|
| 3,847,388 | * | 11/1974 | Lynch | 271/220 |
| 4,883,265 | * | 11/1989 | Iida et al. | 271/220 |
| 5,093,690 | * | 3/1992 | Ohno et al. | 271/184 |
| 5,288,062 | * | 2/1994 | Rizzolo et al. | 271/220 |

FOREIGN PATENT DOCUMENTS

| | | | | |
|---|---|---|---|---|
| 56-78761 | | 6/1981 | (JP) . | |
| 360056766A | * | 4/1985 | (JP) | 271/220 |
| 0261161 | * | 10/1989 | (JP) | 271/220 |
| 0215648 | * | 8/1990 | (JP) | 271/220 |

* cited by examiner

*Primary Examiner*—H. Grant Skaggs
(74) *Attorney, Agent, or Firm*—Foley & Lardner; Bernard L. Kleinke

(57) ABSTRACT

A document conveyance device for conveying single documents on a document stack is described, which includes at least one driven conveying shaft with the interval of the driven conveying shaft from the document stack being variable. The driven conveying shaft includes at least one document conveyance system which comprises a toothed wheel, fixedly disposed on the conveying shaft, with outer toothing and a concentric ring with inner toothing. On the outer ring a friction coating is disposed. The teeth of the toothed wheel and the inner toothing are always meshed in an engagement point. A force component fed in under definition, engages the concentric outer ring such that a force component between the friction coating of the outer ring and the document to be conveyed is active.

11 Claims, 3 Drawing Sheets a)

b)

DOCUMENT CONVEYANCE SYSTEM FOR CONVEYING SINGLE DOCUMENTS

CROSS-REFERENCE TO RELATED APPLICATIONS

Not Applicable

STATEMENT REGARDING FEDERALLY SPONSORED

RESEARCH OR DEVELOPMENT

Not Applicable

REFERENCE TO A "MICROFICHE APPENDIX"

Not Applicable

BACKGROUND OF THE INVENTION

1. Technical Field

The field of the present invention generally relates to a document-processing office machine such as a printer, copier, sorter, document feeding device or a document stacking device. More particularly, the invention relates to an office machine in which single documents of different types can be conveyed.

2. Background Art

In an office machine it is often desirable to transport a document with low force and in which, during the conveyance of the documents to an alignment edge, the documents are not damaged or destroyed. This is desirable even though the document conveyance system continues to act on the document for a specific time after the document has run up to the alignment edge.

Devices for conveying single documents onto document stacks are known. For example, these devices may operate with flexible driving elements such as rubber belts which loosely rest on and drive the documents. Other known devices have rotating fingers comprising flexible materials with a high coefficient of friction which contact and rotatably drive the documents. Yet other known devices have special form wheels with a multiplicity of finger-like structures which are disposed symmetrically at the circumference.

In these known solutions it is disadvantageous that no constant and predetermined conveying speed can be attained since the conveying speed, in particular in the case of solutions involving fingers and form wheels, depends strongly on the axis interval between the driving shaft from the document. It is also a disadvantage that, due to the flexibility of the conveying media, the phase relation between the drive and the document movement is indeterminate.

SUMMARY OF THE INVENTION

It is an object of the present invention to create a document conveyance system in which the documents are conveyable safely and uniformly and at a predetermined speed with a very low conveying force. It is a further object that during the running-up of the documents, in spite of the action of the conveying force on the documents, the documents are not damaged or destroyed.

To meet the objects of the present invention and to overcome the disadvantages of known devices, herein is prescribed a novel document conveyance system. The document conveyance system has inner teeth on a concentric ring. A friction coating is disposed on the outside of the ring. The ring is coupled to a driven toothed wheel having a smaller partial circle diameter than the inner teeth of the outer ring. The ring, together with the friction coating, is set into constant rotation by the driven toothed wheel and the ring. Action of a defined force F, is placed with a force component F1 onto a document to be conveyed in order to generate a document conveying force F2.

The contact point of the friction coating to the document in reference to the direction of conveyance, is always behind the point of engagement of the driving inner toothed wheel. In such a manner the document is pulled. When the document is blocked, the ring is raised above the driving toothed wheel so that the friction force between the friction coating 13 and the document to be conveyed is reduced.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein.

BEST MODE FOR CARRYING OUT THE INVENTION

Figure 1:
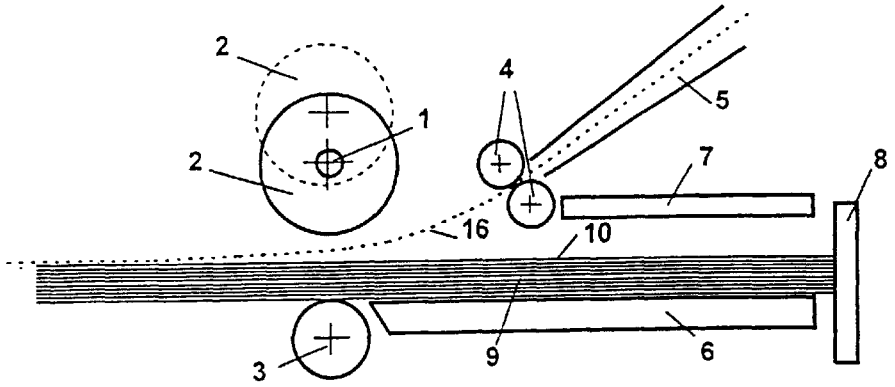
FIG. 1 is a schematic representation of a stacking tray in an office machine for collecting and aligning single documents to form a document stack.

Referring to FIG. 1, there is shown a document collecting device made in accordance with the present invention. The document collecting device of FIG. 1 is an apparatus attached to a printer. The device is configured to printed sheets from the printer and deposit the sheets in sorted form on a stack of 3000 sheets, for example.

The sheets may be deposited as a single documents, or as part of a printing job set which can be collected in a separate collection module. The printing job set can be aligned flush with the edges and, if necessary, can also be stapled as a document Referring now to FIG. 1, an arriving document (shown in dotted lines) is guided in the document guidance channel 5 along the document intake line 16 and conveyed by the document feeding rollers 4 toward the document stack 9. The document conveyance system 2 is raised from the document stack 9 and is disposed in position 2'. The arriving document thus slides onto the document stack 9.

When the rear edge of the arriving document has left the document conveying rollers 4, a driven conveying shaft 1, with the document conveyance system 2, is lowered onto the document stack 9 and conveys the uppermost document 10 on the document stack 9 in the opposite direction and up to an alignment edge 8. Through the automatically limited conveying force of the document conveyance system 2 the conveyed document 10 can automatically align itself and is subsequently disposed in precisely the same position as all documents of the document stack 9.

Figure 2:
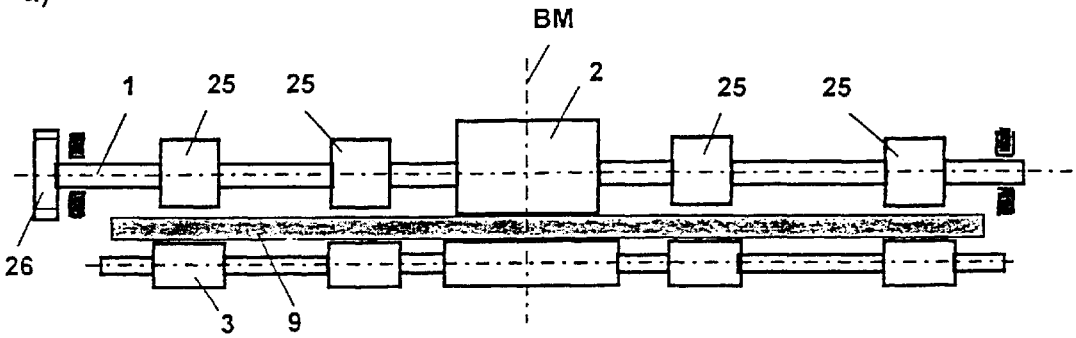
FIG. 2*a* shows a document conveyance system with a driven conveying shaft disposed centrally with respect to a document.
FIG. 2*b* is a configuration of two document conveyance systems 2 on the driven conveying shaft 1 disposed symmetrically with respect to the document center BM.
Figure 2:
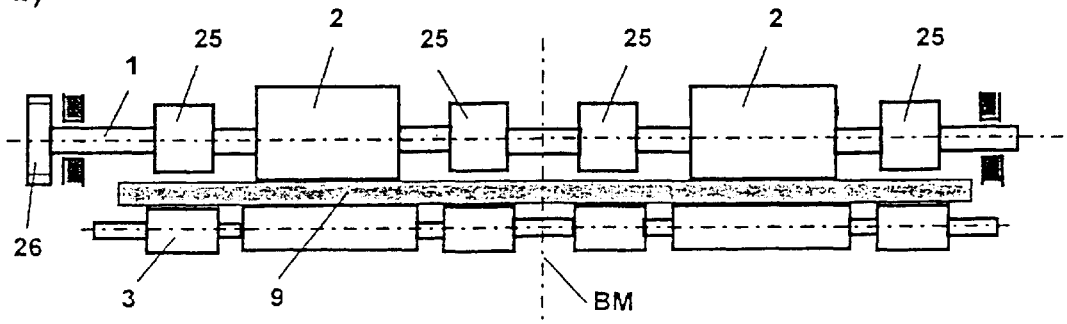

FIG. 2 shows possible configurations of the document conveyance systems 2 on the driven conveying shaft 1. FIG. 2*a* shows a document conveyance system disposed centrally with respect to the document, whereas FIG. 2*b* shows two document conveyance systems 2 disposed symmetrical with respect to the document center.

FIGS. 3*a* and 3*b* show the most essential functional elements required for describing the operation of the document conveyance system 2. FIG. 3*a* shows the document conveyance system 2 in a position raised from the document stack 9 and FIG. 3*b* shows the document conveyance system 2 placed onto the document stack 9 in its operating position.

Figure 3:
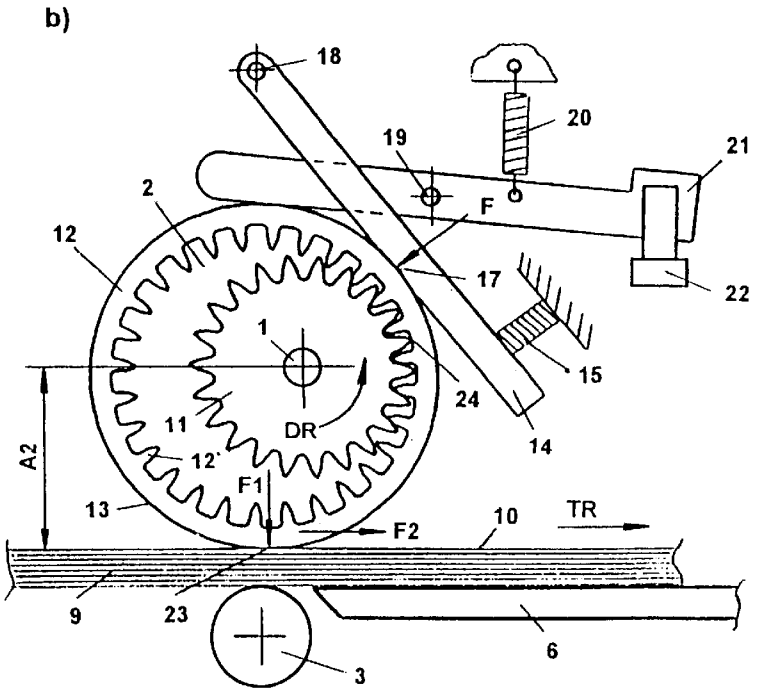
FIG. 3*a* is a representation of the function elements of the document conveyance system 2 in a position in which the document conveyance system 2 is not in contact with the uppermost document 10.
FIG. 3*b* is a representation of the function elements of the document conveyance system 2 in a position for conveying the uppermost document 10 on the document stack 9.
Figure 3:
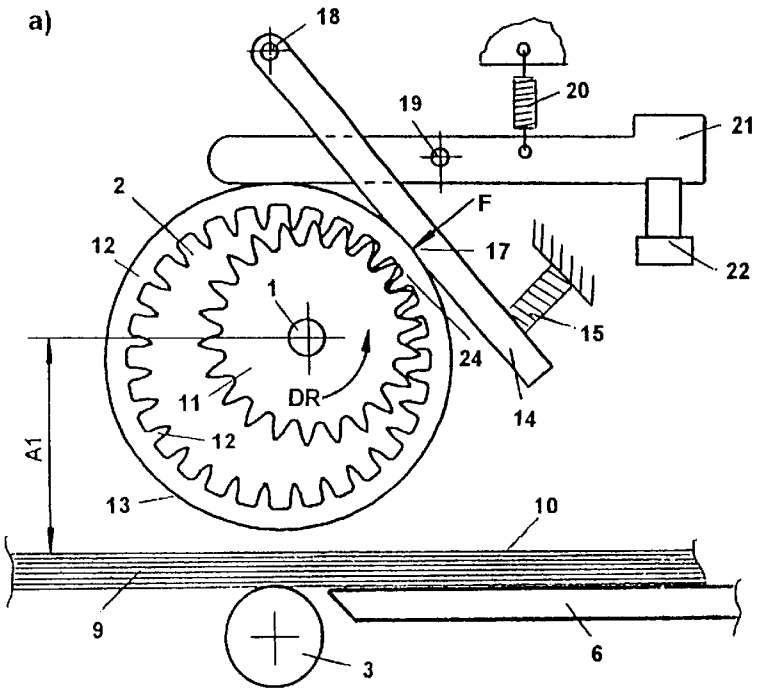
Figure 4:
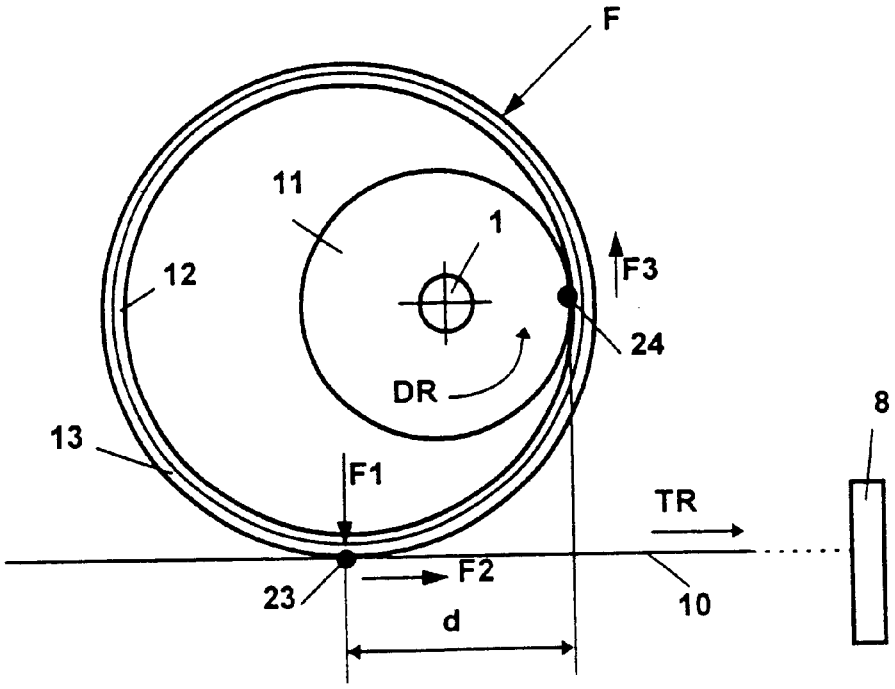
FIG. 4 is a schematic representation to explain the function of the document conveyance system 2.

The document conveyance system will be further described while referring to FIGS. 3 and 4. A toothed wheel 11 is disposed fixedly on the driven conveying shaft 1, which engages at the engagement point 24 the teeth 12' of ring 12. The toothed wheel 11 is markedly smaller than the inner teeth 12' of ring 12. Thereby the ring 12, with respect to the toothed wheel 11, can assume different positions.

A pressure stay bar 14 which is supported rotatably in pivot 18, contacts the ring 12 at point 17. A force component F becomes active through a compression spring 15 onto ring 12 such that, as shown in FIG. 3*a*, the ring 12 assumes a defined position with respect to the toothed wheel 11. In FIG. 3*a* the axis interval A1 between the driven conveying shaft 1 and the uppermost document 10 of the document stack 9 is set such that a friction coating 13 of the ring 12 does not contact the uppermost document 10 of the document stack 9.

A sensor lever 21 is supported rotatably in pivot 19 and prestressed through a tension spring 20 and is for sensing the position of ring 12. A sensor 22 detects that the ring 12 is not in contact with the document stack 9. The sensor 22 may be an optical sensor.

In FIG. 3*b* the axis interval A2 is set so that ring 12, with the friction coating 13, rests on the uppermost document 10 of the document stack 9. The friction coating 13 has a coefficient of friction greater than 1 with respect to the document. Upon rotation of the driven conveying shaft 1 in the direction of rotation DR, a document conveying force F2 is generated which moves the uppermost document 10 in the direction of conveyance TR.

In order to attain the correct force component F1 at the contact point 23 on the document stack 9, the axis interval A2 is decreased until the sensor 22 detects via the sensor lever 21 a predetermined position.

The basic function of the document conveyance system 2 will be explained in conjunction with FIG. 4. At the contact point 23 of the friction coating 13 a force component F1 is generated onto the document 10. As generally described above, the force F1 results from the force F at engagement point 24. The teeth of the toothed wheel 11 also mesh at the engagement point 24 with teeth 12' of ring 12. When the toothed wheel 11 is driven via the driven conveying shaft 1 in the direction of rotation DR a force component F3 is generated onto the ring 12. The force F3 is generated perpendicularly away from the document stack 9. Also, at contact point 23, a force component F2, is generated which moves the document 10 in the direction of conveyance TR.

The force components F1 and F3 are directed oppositely as shown in FIG. 4. When the coefficient of friction between the friction coating 13 and the document 10 to be conveyed is greater than the coefficient of friction between the document 10 to be conveyed and the document stack 9, the force component F3 applied through the driven toothed wheel 11, is always smaller than the force component F1. Through the net magnitude of F1 a force component F2 always results which conveys the document.

If the document 10 is decelerated, the force component F3, which is applied via the toothed wheel 11, increases. Through the increase of the force component F3, with a constant force F, the force component F1 at contact point 23 is reduced and, via the coefficient friction, also the force component F2 in the direction of conveyance TR of document 10. The friction coating thereby changes from adhering friction on the document 10 into sliding friction with reduced frictional force.

Through a finite interval d, which is between the engagement point 24 of the toothing and the contact point 23 and between the friction coating 13 and the uppermost document 10, document 10 is always pulled and cannot become jammed when document 10 is blocked.

When the document stack 9 has collected the desired number of sheets, the document stack 9 can be conveyed further as a set. For this purpose the conveying shaft 1 is lowered so far onto the document stack 9 that further friction rollers 25 disposed on the conveying shaft 1 engage the document stack 9. In cooperation of these friction rollers 25 and lower opposing pressure rollers 3, the document stack 9 is conveyed as a complete set. The document conveyance system 2 is therein ineffective due to the greater pressure force of the friction rollers 25.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A document conveyance device for conveying single documents on a document stack, comprising:

a driven conveying shaft, with the distance between the driven conveying shaft and the document stack being variable;

at least one document conveyance system on the driven conveying shaft;

a toothed wheel fixedly disposed on the conveying shaft, the toothed wheel having outer toothing;

an outer ring having inner toothing, with a friction coating disposed thereon, and with teeth of the toothed wheel and the inner toothing always being meshed in an engagement point; and wherein the outer ring is pressed onto a document to be conveyed such that a force component is generated between the friction coating of the outer ring and the document at a contact point.

2. The document conveyance device according to claim 1 wherein only one document conveyance system is disposed centrally with respect to a document to be conveyed on the driven conveying shaft.

3. The document conveyance device according to claim 1 wherein several document conveyance systems are disposed symmetrically with respect to a document center on the driven conveying shaft.

4. The document conveyance device according to claim 1 wherein the toothed wheel fixedly disposed on the driven conveying shaft comprises fewer teeth than the inner toothing of the outer ring.

5. The document conveyance device according to claim 1 wherein the teeth of the toothed wheel and the teeth of the inner toothing are structured in profile such that the teeth engagement depth is variable.

6. The document conveyance device according to claim 1 wherein the outer diameter of the friction coating is greater than the outer diameter of adjacent concentric friction rollers which are disposed fixedly on the driven conveying shaft.

7. The document conveyance device according to claim 1 wherein the contact point of the friction coating rests on the document behind the engagement point of the toothed wheels relative to the direction of conveyance of the document.

8. The document conveyance device according to claim 1 wherein the outer ring is connected via a sensor: lever to an sensor such that, based on sensor information, an effective force component for conveying the document can be derived.

9. The document conveyance device according to claim 8, wherein the sensor is an optical sensor.

10. The document conveyance device according to claim 1 wherein the friction coating on the ring has a coefficient of friction greater than 1 with respect to the document.

11. The document conveyance device according to claim 1 wherein the ring comprises a material which ensures the dimensional stability of the ring.

* * * * *